US010364483B1

(12) United States Patent
Stanford et al.

(10) Patent No.: US 10,364,483 B1
(45) Date of Patent: Jul. 30, 2019

(54) HIGH HARDNESS, HIGH ELASTICITY INTERMETALLIC COMPOUNDS FOR MECHANICAL COMPONENTS

(71) Applicant: The United States of America as represented by the Administrator of the National Aeronautics and Space Administration, Washington, DC (US)

(72) Inventors: Malcolm K. Stanford, Cleveland, OH (US); Ronald D. Noebe, Medina, OH (US); Christopher DellaCorte, Cleveland, OH (US); Glen Bigelow, Cleveland, OH (US); Fransua Thomas, Cleveland, OH (US)

(73) Assignee: The United States of America as Represented by the Administrator of National Aeronautics and Space Administration, Washington, DC (US)

( * ) Notice: Subject to any disclaimer, the term of this patent is extended or adjusted under 35 U.S.C. 154(b) by 300 days.

(21) Appl. No.: 14/191,708

(22) Filed: Feb. 27, 2014

Related U.S. Application Data

(60) Provisional application No. 61/771,149, filed on Mar. 1, 2013.

(51) Int. Cl.
*C22C 19/03* (2006.01)
*C22C 19/00* (2006.01)

(52) U.S. Cl.
CPC ..... *C22C 19/007* (2013.01); *C22C 19/03* (2013.01)

(58) Field of Classification Search
CPC ..... C22C 19/00; C22C 1/023
See application file for complete search history.

(56) References Cited

U.S. PATENT DOCUMENTS 5,843,244 A 12/1998 Pelton et al.
6,177,046 B1 1/2001 Simkovich et al.
6,638,375 B2 10/2003 Fujita et al.
7,311,981 B2 12/2007 Saint Ramond et al.
7,569,251 B2 8/2009 Saint-Ramond et al.
2008/0260573 A1 10/2008 Ishida et al.
2009/0245702 A1 10/2009 Kagohara et al.
2011/0168451 A1 7/2011 DiGiovanni et al.
2012/0319445 A1 12/2012 Zolno et al.

OTHER PUBLICATIONS

C. DellaCorte, Nickel-Titanium Alloys: Corrosion "Proof" Alloys for Space Bearing, Components and Mechanism Applications, May 2010, Proceedings of the 40th Aerospace Mechanisms Symposium, NASA Kennedy Space Center, pp. 293-299.*
Baker et al., ASM Handbook, vol. 03—Alloy Phase Diagrams—2. 6.861 Ni—Ti, (1992), ASM International, p. 319, Online version available at: http://app.knovel.com/hotlink/pdf/id:kt007P33Y2/asm-handbook-volume-03/ni-ti.*
Bozzolo, G., Noebe, R. D., & Mosca, H. O. (2005). Site preference of ternary alloying additions to NiTi: Fe, Pt, Pd, Au, Al, Cu, Zr and Hf. Journal of alloys and compounds, 389(1), 80-94.*
J. Martin-Ramos, A. Cambeses, A. López-Galindo, J. Scarrow and J. Díaz-Hernández, Pathways for quantitative analysis by X-Ray diffraction, INTECH Open Access Publisher, 2012.
S.M. Saghaian, H.E. Karaca, H. Tobe, J. Pons, R. Santamarta, Y.I. Chumlyakov, R.D. Noebe, "Effects of Ni content on the shape memory properties and microstructure of Ni-rich NiTi—20Hf alloys," Smart Materials and Structures, vol. 25 (2016) 095029.
OO. Benafan, G.S. Bigelow, and D.A. Scheiman, "Transformation behavior in NiTi—20Hf shape memory alloys—Transformation temperatures and hardness," Scripta Materiala 146 (2018) 251-254.
Malcolm K. Stanford, "Hardness and Microstructure of Binary and Ternary Nitinol Compounds," NASA/TM—2016-218946, available at https://ntrs.nasa.gov/archive/nasa/casi.ntrs.nasa.gov/20160001689.pdf.

* cited by examiner

*Primary Examiner* — Jessee R Roe
*Assistant Examiner* — Jophy S. Koshy
(74) *Attorney, Agent, or Firm* — Robert H. Earp, III; William M. Johnson

(57) ABSTRACT

One or more substitutional elements may be used to reduce the solution treatment temperature and required quench rates for hardening of 60-NITINOL. The advantages of modified NITINOL include that less energy is consumed during the heat treatment process, the material is subjected to less thermal distortion, and less machining is required. Modified NITINOL may have adequate hardness for bearing applications and may display highly elastic behavior.

9 Claims, 15 Drawing Sheets

RELATED ART

400

RELATED ART

410

RELATED ART

420

RELATED ART

430

440

450

500

700

RELATED ART

HIGH HARDNESS, HIGH ELASTICITY INTERMETALLIC COMPOUNDS FOR MECHANICAL COMPONENTS

CROSS REFERENCE TO RELATED APPLICATION

This application is a non-provisional of, and claims priority to, U.S. Provisional Patent Application Ser. No. 61/771,149 filed Mar. 1, 2013. The subject matter of this earlier-filed application is hereby incorporated by reference in its entirety.

ORIGIN OF THE INVENTION

The invention described herein was made by employees of the United States Government and may be manufactured and used by or for the Government for Government purposes without the payment of any royalties thereon or therefore.

The invention described herein was also made in the performance of work under a NASA contract and is subject to the provisions of Section 305 of the National Aeronautics and Space Act, Public Law 111-314, § 3 (124 Stat. 3330, 51 U.S.C. Chapter 201).

FIELD

The present invention generally pertains to materials, and more specifically, to highly elastic intermetallic compounds that may be processed at lower temperatures than conventional 60-NITINOL based intermetallic compounds.

BACKGROUND

60-NITINOL is a superelastic ordered intermetallic compound that is well suited for shock-resistant aerospace bearing applications and formed from nickel (Ni) and titanium (Ti). 60-NITINOL was discovered in the 1960s, but was not commercialized because it was difficult to machine with conventional technology at that time, partly because of the issue of residual stresses and quench cracking. However, there is renewed interest in the material within the aerospace community since it can be machined using techniques that have been developed since its discovery and due to its unique combination of physical properties.

60-NITINOL is corrosion-proof, electrically conductive, non-magnetic, and benign in the presence of conventional lubricants. 60-NITINOL, paradoxically, is also very hard, yet highly resistant to damage from shock loads. The high hardness of this material, which is critical to its use in mechanical components such as bearings, is achieved through heat treatment.

However, the high temperatures required to heat treat the material to maximum hardness have been found to cause thermal distortion and, in some cases, quench cracking, which can render an article unusable after an investment of many hours of machining time. A partial phase diagram 100 for binary Ni—Ti is shown in FIG. 1. FIG. 1 shows the phase structure of Ni—Ti alloys as a function of temperature and composition, where the top horizontal axis indicates the amount of Ti by weight percent and the bottom horizontal axis indicates the amount of Ti by atomic percent. The Naval Ordnance Laboratory initially identified the potential uses of compositions consisting of 55% and 60% Ni by weight, with the balance being Ti, and named these compositions 55-NITINOL and 60-NITINOL, respectively. However, the phase diagram indicates an entire range of compositions from approximately 55-61% Ni by weight (50-57 atomic percent Ni). The hardness of the material increases with increasing Ni content within this composition range (i.e., the γ-phase field in FIG. 1), which requires concomitantly higher solution treatment temperatures.

As seen in the Ni—Ti phase diagram, austenitic NiTi (the phase labeled γ at the center of FIG. 1) is formed when NiTi is heated above the solvus line (at approximately 1050° C. for 60-NITINOL) and then immediately quenched to room temperature. This process is known as a solution treatment. The solution treated material can then be reheated to an intermediate temperature in a process known as aging where small precipitates coalesce and grow.

These precipitates increase the hardness of the material. However, the thermal stresses created by quenching from above 1000° C. can cause the material to warp. If the stress within a component encounters a stress riser, such as a sharp radius or near surface defect (e.g., an inclusion, a pore, a machining defect, or another surface disparity), the component can fracture. 60-NITINOL has many technical advantages, but challenges arise in heat treating the material to sufficient hardness for aerospace component applications without producing residual stresses that result in cracked or distorted parts. Accordingly, an improved material that maintains hardness, but mitigates against thermal distortion and quench cracking, may be beneficial.

SUMMARY

Certain embodiments of the present invention may be implemented and provide solutions to the problems and needs in the art that have not yet been fully solved by conventional superelastic compounds. For example, the modified NITINOL material in some embodiments can be heat treated and sufficiently hardened at lower temperatures, which significantly reduces the occurrence of dimensional distortion and eliminates quench cracking. In addition, in some embodiments, the severe water quench may not be necessary. As such, approaches with slower cooling rates, such as air cooling or even furnace cooling, can be used while still maintaining the desired high hardness levels.

In one embodiment of the present invention, a material includes 51-57 atomic percent nickel (Ni) and up to 27 atomic percent zirconium (Zr), hafnium (Hf), rutherfordium (Rf), lanthanum (La), or tantalum (Ta). The balance of the material is titanium (Ti) by atomic percent.

In another embodiment of the present invention, a material includes 51-57 atomic percent nickel (Ni) and up to 27 atomic percent of any combination of two or more of zirconium (Zr), hafnium (Hf), rutherfordium (Rf), lanthanum (La), and tantalum (Ta). The balance of the material is titanium (Ti) by atomic percent.

In yet another embodiment of the present invention, a composition of matter includes 54-56 atomic percent nickel (Ni) and up to 5 atomic percent of a combination of zirconium (Zr) and hafnium (Hf). The balance of the material is titanium (Ti) by atomic percent.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE EMBODIMENTS

Some embodiments of the present invention add a ternary substitutional element or multiple substitutional elements for some of the Ti in 60-NITINOL (hereinafter "modified NITINOL"). Lessons learned during the development of applications for this material lead to the discovery that with the inclusion of one or more substitutional elements, the resulting modified NITINOL can be thermally processed at a lower temperature to attain at least the same desirable hardness level as 60-NITINOL. Processing at a lower temperature is beneficial not only because it reduces processing costs from energy consumption, but also because such processing reduces or eliminates the possibility of quench cracking and thermal distortion, which have been problematic with 60-NITINOL. In addition to being able to solution treat the modified alloys at lower temperatures, the materials can also be hardened without the need for an extreme water quench in some embodiments. Approaches with slower cooling rates, including air cooling, can be used in the processing of these modified NITINOL alloys and still produce high hardness values.

Modified NITINOL compounds are candidates for the next generation of material for shock-tolerant bearings, which already has a potential application on the International Space Station. Practical applications include aerospace components such as gears and bearings. However, some embodiments may be suitable for any application where a metallic, hard, resilient (i.e., low elastic modulus), non-magnetic, electrically conductive, corrosion-resistant material is desired. Such applications include, but are not limited to, wind turbines, x-ray tubes, marine applications (where corrosion is an issue), and various industrial applications (e.g., petrochemical processing, chemical processing, food processing, etc.).

Figure 1:
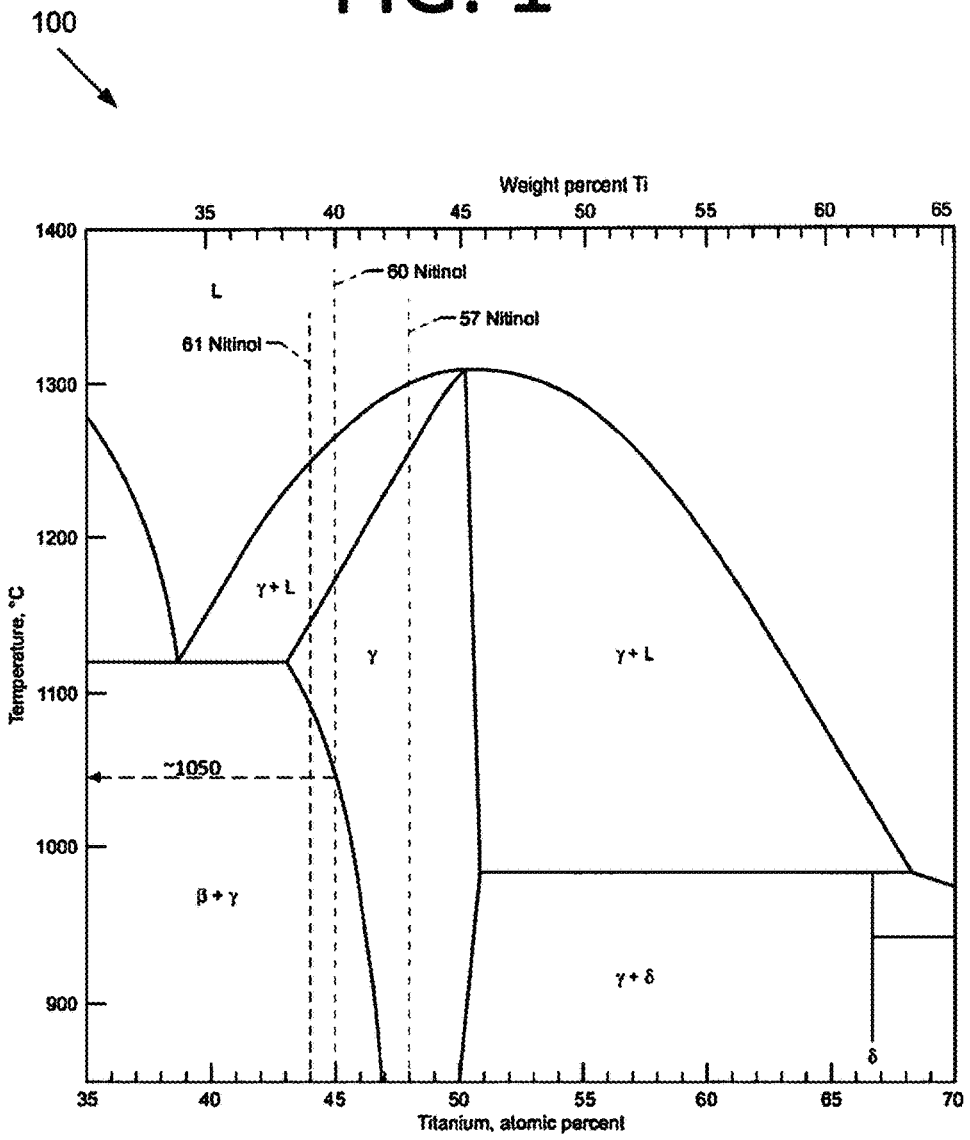
FIG. 1 is a partial phase diagram for binary Ni—Ti.
Figure 2A:
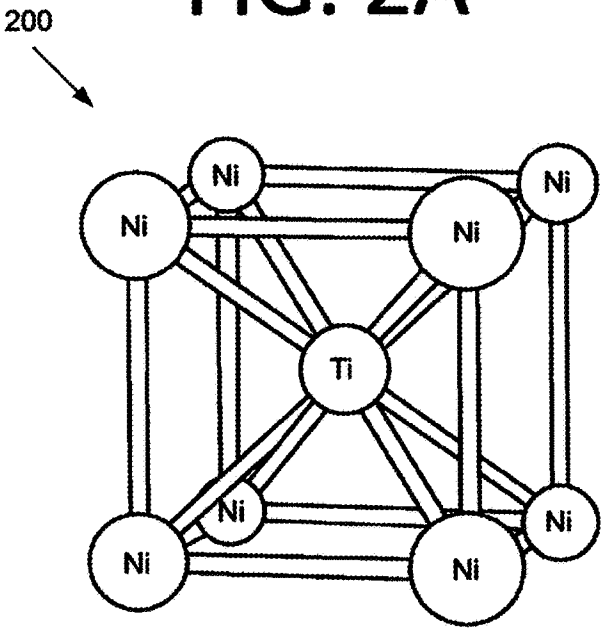
FIG. 2A illustrates a B2 unit cell with Ni corners and Ti at the center.
Figure 2B:
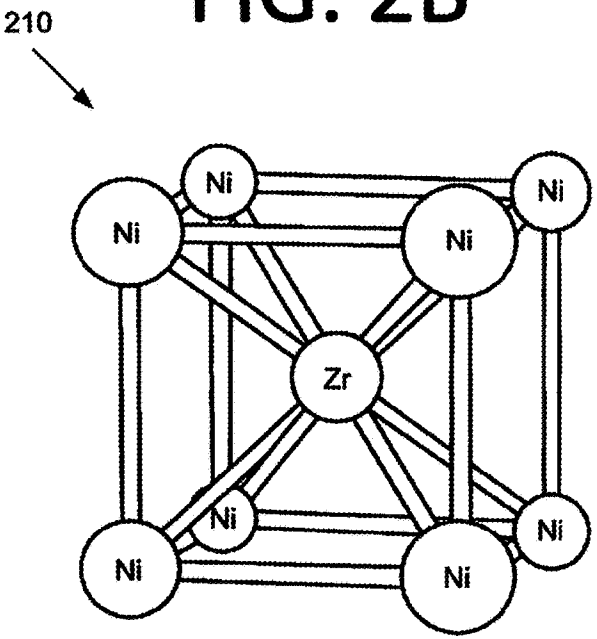
RELATED ART FIG. 2B
FIG. 2B illustrates a B2 unit cell with Ni corners where Zr has replaced Ti at the center of some fraction of these cells, according to an embodiment of the present invention.

60-NITINOL generally has a B2 crystallographic unit cell structure as illustrated in B2 unit cell 200 of FIG. 2A, with eight Ni atoms at the corners and a single Ti atom at the center of a cubic configuration. This structure is repeated to form an ideal or near-ideal crystal structure. In some of the cells, Ni takes the place of Ti, which results in precipitation and adds internal stress that makes the material harder. However, in modified NITINOL, Ti atoms in some of the unit cells are replaced with another element, such as the Zr shown in unit cell 210 of FIG. 2B. This may reduce the heat treatment temperature needed to reach the desired hardness for the material.

It has never previously been proposed that a ternary element, or combination of additional elements, could be used to suppress the solvus temperature of NITINOL compounds. In some embodiments, hafnium (Hf), rutherfordium (Rf), lanthanum (La), and tantalum (Ta) may be used instead of Zr. In certain embodiments, any combination of these elements may be used. For instance, some unit cells may have Zr at the center, some may have Hf at the center, some may have Ta at the center, etc. Certain elements, such as Zr and Hf, are found in the presence of one another and generally cannot be conventionally refined to a high degree of purity. For instance, using conventional processing, these elements tend to cross-contaminate by approximately 3% by weight. However, this cross-contamination does not negatively impact the properties of the material. By adding one or more of these elements to the material, the heat treatment temperature required to achieve the desired hardness may be reduced such that residual thermal stresses are not a factor. The discovery that these elements are effective at suppressing the solvus temperature is novel and represents a major finding. Of similar value and novelty is the discovery that these elements can also be used to harden NITINOL compounds in some embodiments without the need for a severe water quench, as required for binary Ni—Ti alloys.

In some embodiments, the ternary element or combination of elements (e.g., Zr, Hf, and Ta) is anywhere from greater than 0 to 27 atomic percent of the modified NITINOL. A larger atomic percent tends to change the phase stability, and thus the beneficial properties may be lost. Also, cost may become an issue in practical applications. It is generally important to keep the hardness high.

In some embodiments, Ni is present in concentrations of 51-57 atomic percent. The ternary element or combination of elements is present in concentrations as high as 27 atomic percent. The remaining balance is Ti. Some compositions of modified NITINOL may be harder than 60-NITINOL.

In a practical example, a ternary intermetallic compound consisting of 54% Ni, 45% Ti, and 1% Hf by atomic percent was prepared by casting. Per the above, in this material, Hf substitutes with some of the Ti in the material. In another practical example, Zr, which is close in chemical behavior to Hf, was used as the substitutional element. With either substitution, the solvus temperature of the material is suppressed and lower temperatures can be used to obtain the desired hardness values.

The advantages of such embodiments include the ability to solution treat the material at a lower temperature and still achieve the desired hardness (at least 50 on the Rockwell C hardness scale (HRC)) for bearings. The material also exhibited highly elastic behavior with recoverable strains greater than 2%. Most structural alloys will not return to their original shape after being deformed as little as 0.2% (a tenth of what is possible with highly elastic materials like 60-NITINOL). Because lower temperatures and slower cooling rates can be used in the heat treatment process, less energy is consumed and there is less dimensional distortion and quench cracking, resulting in fewer scrap parts, less material waste due to large amounts of material removal, and fewer machining steps to rework parts that are out of specification.

The modified NITINOL of some embodiments has a combination of properties that have been previously unobtainable. Some embodiments of modified NITINOL may have a Youngs modulus of less than 110 gigapascals (GPa), which is about half that of conventional steels, a moderate density of approximately 6.5 g/cm$^3$ (10-15% lower than conventional steels), and a high hardness (~58-62 HRC). These properties make such a material uniquely suited for advanced bearings.

When a bearing experiences high radial loading, such as during launch onboard a space vehicle or due to poor handling during assembly, the balls may dent the bearing races. These dents may become the source of premature wear failure. However, 60-NITINOL resists this type of damage due to its high hardness and low apparent modulus, unlike conventional bearing alloys. A difference of modified NITINOL is that these properties can be obtained by heat treatment at lower temperatures and slower cooling rates.

Table 1 shows heat treatments and resultant hardness for 60-NITINOL and an embodiment of Ni—Ti—Hf modified NITINOL after various heat treatments.

TABLE 1

HEAT TREATMENTS AND RESULTANT HARDNESS

| Designation | Heat Treatment | Hardness (HRC) 60-NITINOL | Hardness (HRC) Modified NITINOL |
|---|---|---|---|
| Water quenched (partially solution treated) | 2 hours at 900° C./water quench (WQ) | 56 ± 2 | 58 ± 2 |
| | 2 hours at 1000° C./WQ | 63 ± 2 | 58 ± 1 |
| | 2 hours at 1050° C./WQ | 63 ± 1 | 60 ± 1 |
| Water quenched and aged | 2 hours at 900° C./WQ; 1 hour at 400° C./WQ | 58 ± 1 | 61 ± 1 |
| | 2 hours at 1000° C./WQ; 1 hour at 400° C./WQ | 61 ± 3 | 62 ± 1 |
| | 2 hours at 1050° C./WQ; 1 hour at 400° C./WQ | 62 ± 1 | 61 ± 1 |

The data shows that in the water quenched condition, both 60-NITINOL and modified NITINOL have hardness greater than 58 HRC, which is adequate for bearing applications. While the hardness of 60-NITINOL is slightly higher after heat treatments at 1000° C. and 1050° C., thermal distortion and quench cracking become a problem at these heat treatment temperatures. After aging, both materials have equivalent hardness. This shows that the modified NITINOL can be heat treated to attain the same hardness as 60-NITINOL without unwanted warping and quench cracking.

Figure 3A:
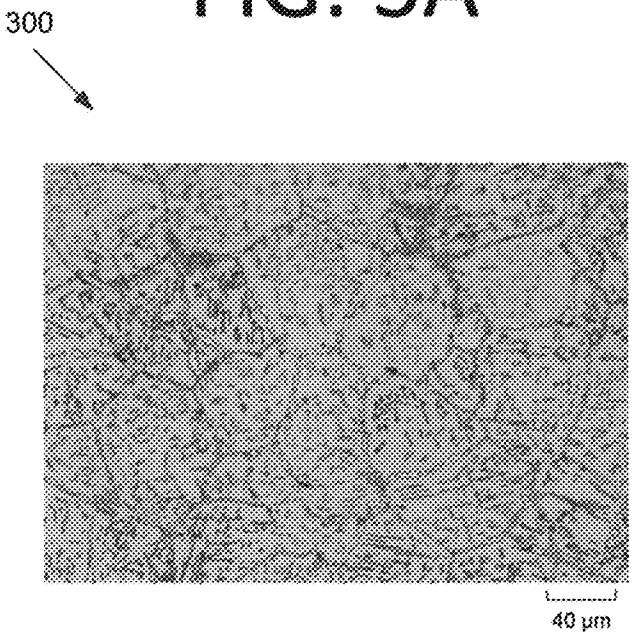
FIG. 3A is an image illustrating microstructures of 60-NITINOL (55 atomic percent Ni and 45 atomic percent Ti).
Figure 3B:
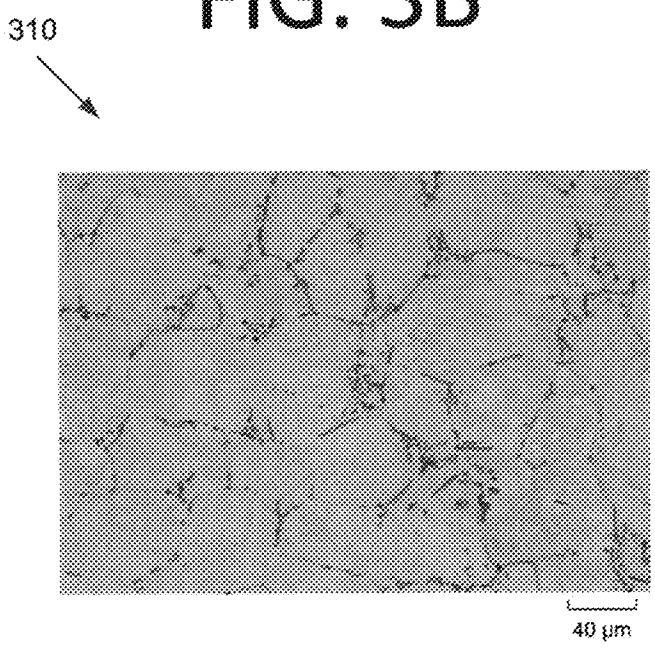
RELATED ART FIG. 3B
FIG. 3B is an image illustrating microstructures of modified NITINOL, according to an embodiment of the present invention.
Figure 4A:
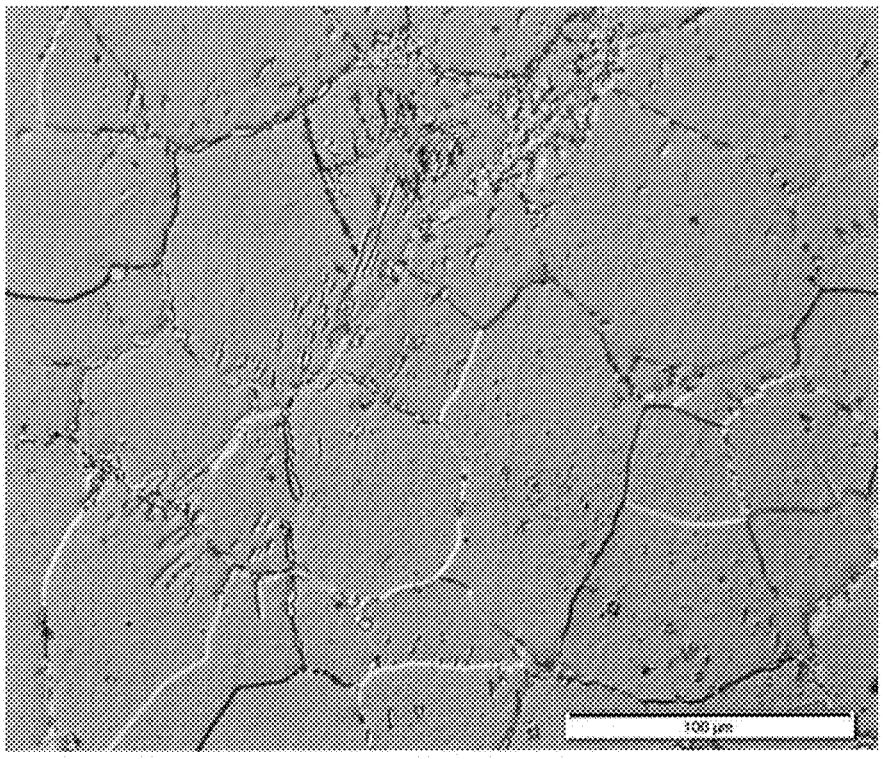
FIG. 4A is an image illustrating the microstructures of 60-NITINOL (55 atomic percent Ni and 45 atomic percent Ti) after water quenching from 900° C.
Figure 4B:
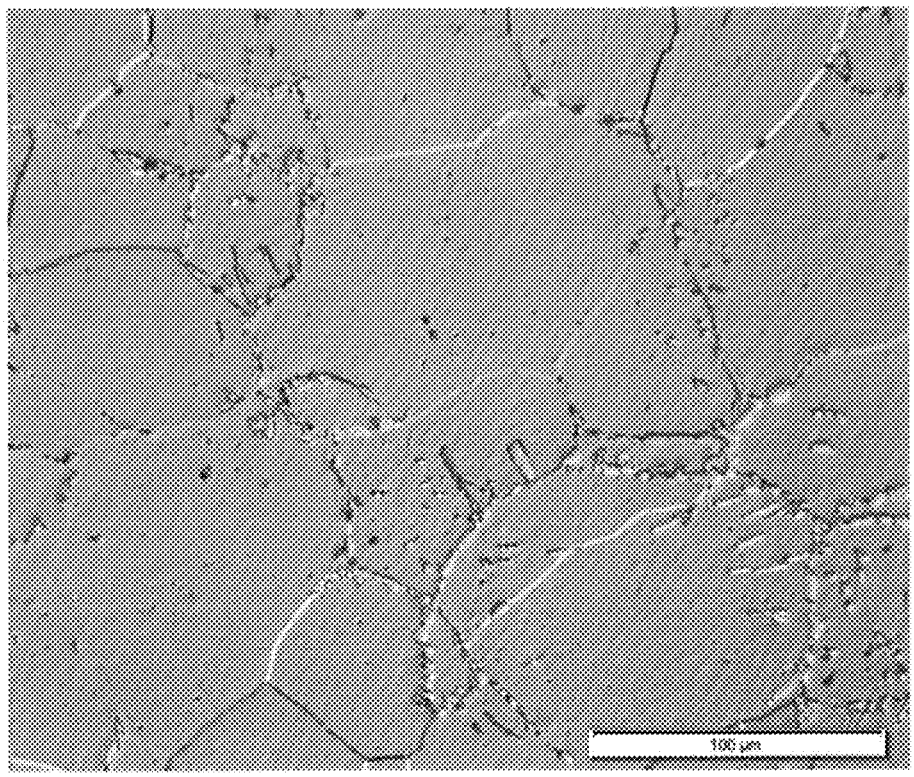
FIG. 4B is an image illustrating the microstructures of 60-NITINOL (55 atomic percent Ni and 45 atomic percent Ti) after water quenching from 1000° C.
Figure 4C:
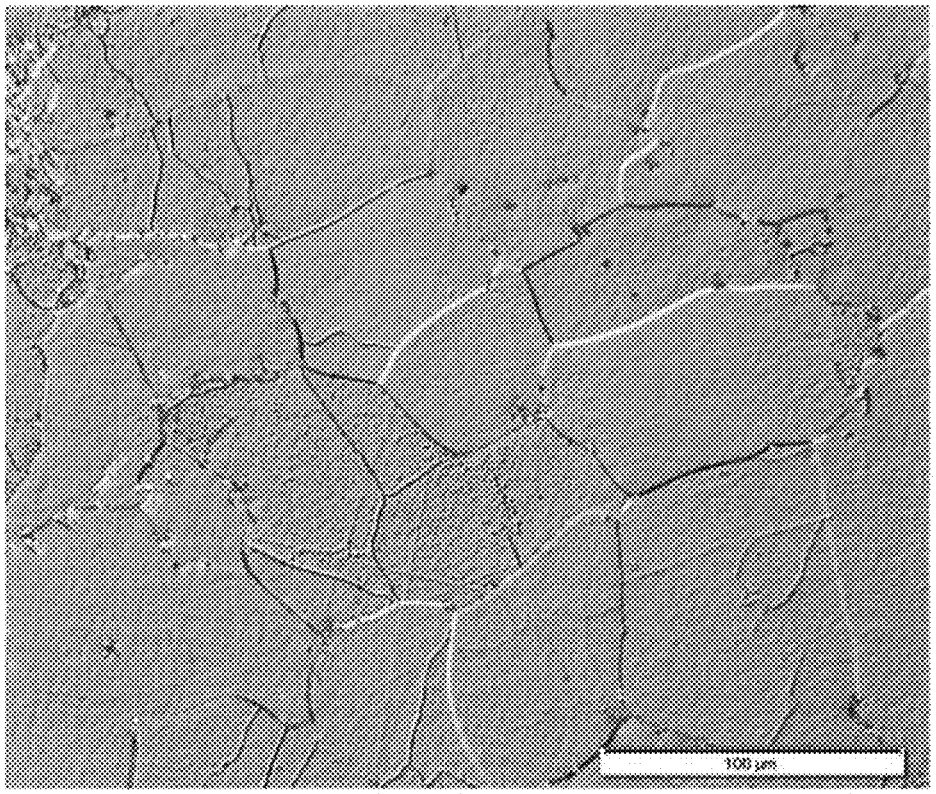
FIG. 4C is an image illustrating the microstructures of 60-NITINOL (55 atomic percent Ni and 45 atomic percent Ti) after water quenching from 1050° C.
Figure 4D:
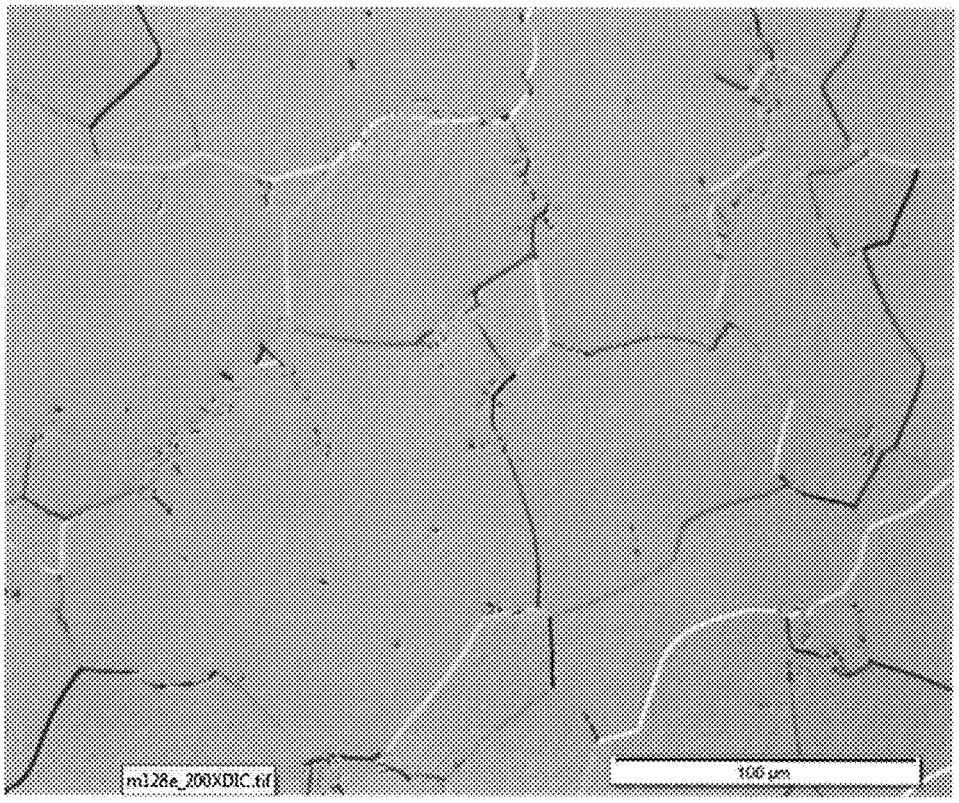
FIG. 4D is an image illustrating the microstructures of modified NITINOL after water quenching from 900° C., according to an embodiment of the present invention.
Figure 4E:
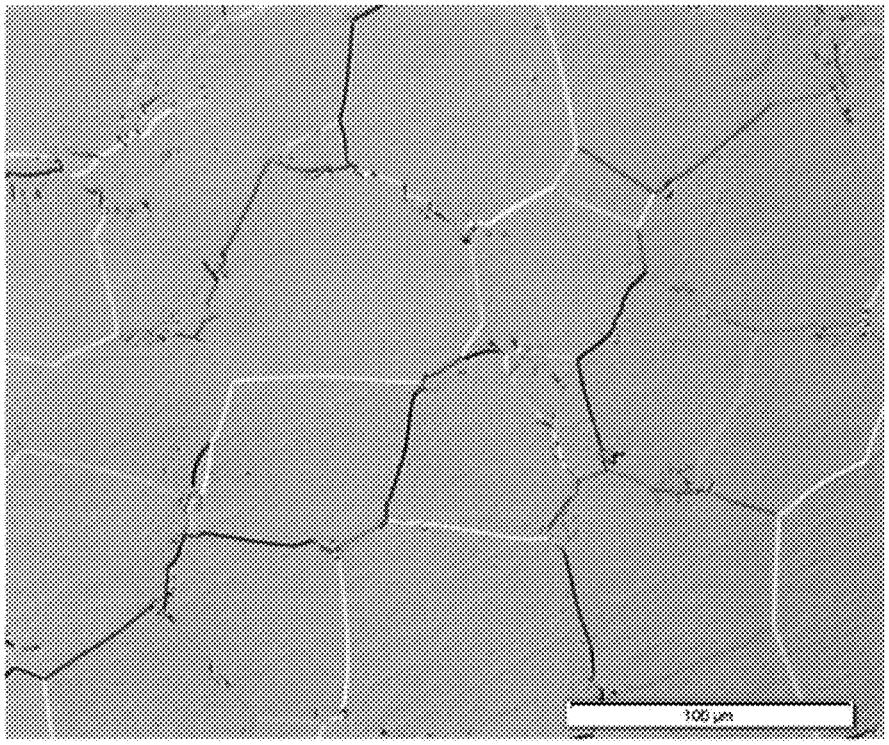
FIG. 4E is an image illustrating the microstructures of modified NITINOL after water quenching from 1000° C., according to an embodiment of the present invention.
Figure 4F:
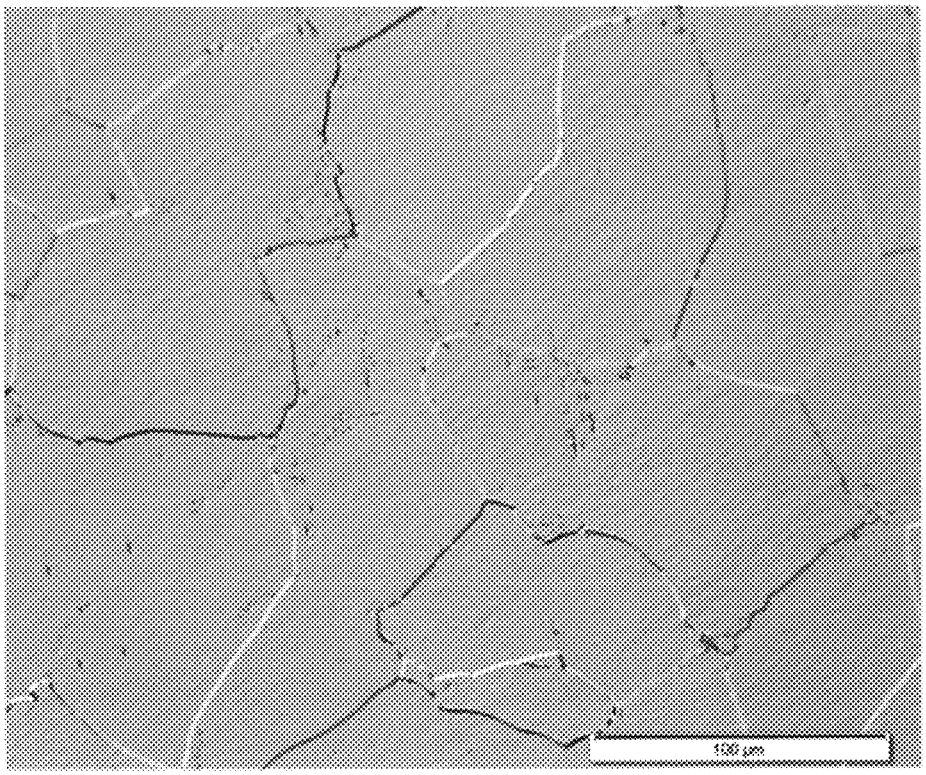
FIG. 4F is an image illustrating the microstructures of modified NITINOL after water quenching from 1050° C., according to an embodiment of the present invention.

FIGS. 3A and 3B are images 300, 310 illustrating microstructures of 60-NITINOL and modified NITINOL, respectively. The gray parent phase of 60-NITINOL in FIG. 3A is B2 Ni—Ti. The acicular lighter second phase within the grains and along the grain boundaries in FIG. 3A is $Ni_3Ti$. This is a hard brittle phase that forms when the material is cooled slowly from processing temperatures. This phase is incoherent, which means the $Ni_3Ti$ phase and B2 Ni—Ti parent phase have a different atomic configuration and do not match across their interface plane. For this reason, the second phase does not create a beneficial strain field within the parent phase of the material, and thus does not increase hardness.

The purpose of the solution treatment step is to dissolve all of this second phase and then quench the material to lock its entire crystal structure in the B2 configuration. From here, the material can be aged at an intermediate temperature (e.g., 400° C.), which will precipitate a fine, coherent $Ni_4Ti_3$ phase. Since the $Ni_4Ti_3$ is coherent, it increases the hardness of the material. The $Ni_4Ti_3$ phase is too small to be seen by optical microscopy, so it is not visible in FIG. 3A or 3B.

The microstructure of modified NITINOL in FIG. 3B has the same grey Ni—Ti parent phase, but the second phase of $Ni_3Ti$ is absent. The grains have a lath pattern and the grain boundaries are decorated with a second phase primarily consisting of $HfO_2$, as determined by x-ray analyses. The Hf acts as an oxygen getter to prevent oxygen from forming titanium oxides, which degrade material properties.

The microstructures of 60-NITINOL and modified NITINOL after water quenching from 900° C., 1000° C., and 1050° C. are shown in images 400-450 of FIGS. 4A-F. After quenching 60-NITINOL, there are still clusters of $Ni_3Ti$ present in the microstructure, typically near the grain boundaries. The $Ni_3Ti$ persists even after heat treatment to 1050° C., even though the phase diagrams indicate that the second phase should completely dissolve at approximately 1000° C.

In the modified NITINOL, however, no $Ni_3Ti$ is detected by optical microscopy or with x-ray diffraction, even before heat treatment. Further testing has shown that as the percentage of Hf is increased in this compound, the solvus temperature is further reduced. Table 2 shows that at each heat treatment temperature, the increase in Hf content reduces the percentage of the second phase present in the microstructure.

TABLE 2

| QUANTITATIVE METALLOGRAPHY RESULTS WITH TERNARY ADDITION | | |
|---|---|---|
| | Second Phase (%) | |
| Heat Treatment Temperature | 1% Hf (atomic) | 5% Hf (atomic) |
| 800° C. | 6.5 | 1.8 |
| 900° C. | 1.6 | 1.3 |
| 1000° C. | 1.4 | 0.4 |

In addition, Table 2 shows that the second phase percentage decreases with increasing heat treatment temperature.

Figure 5:
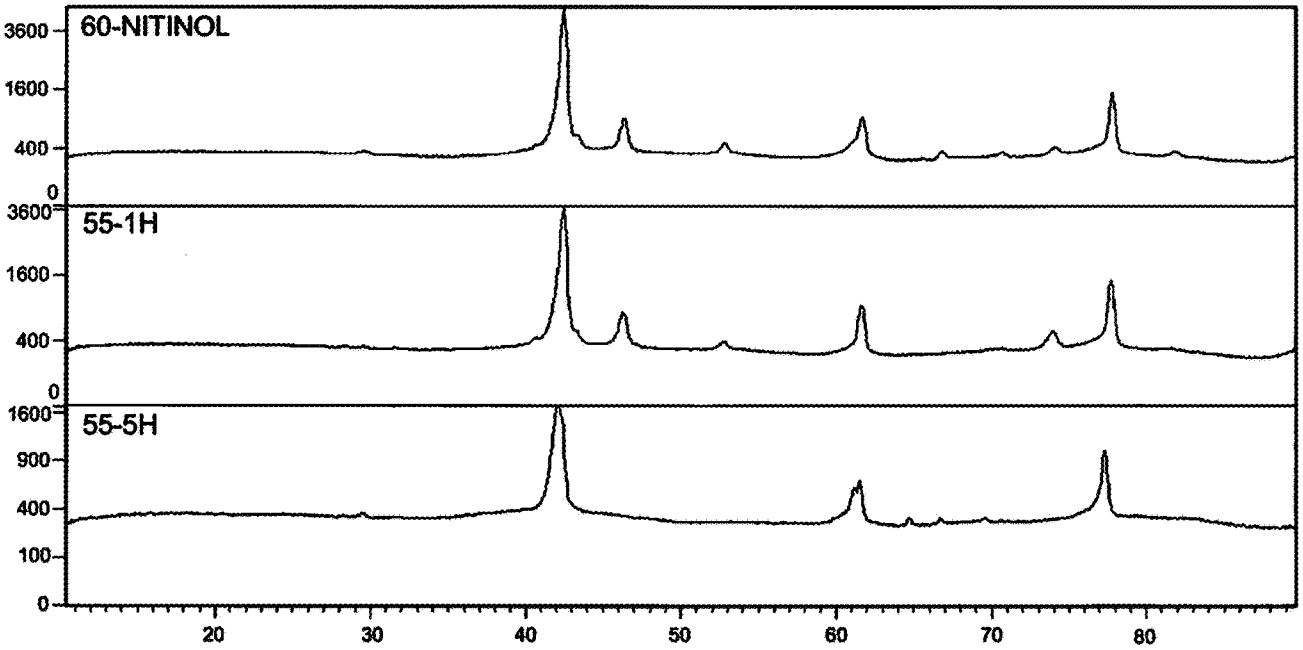
FIG. 5 is a plot of x-ray diffraction spectra for 60-NITINOL and two modified NITINOL alloys, according to an embodiment of the present invention.

FIG. 5 is a plot 500 of x-ray diffraction peaks for 60-NITINOL and two versions of modified NITINOL, 59 wt. % Ni—38 wt. % Ti—3 wt. % Hf (55 at. % Ni—44 at. % Ti—1 at. % Hf) and 53 wt. % Ni—32 wt. % Ti—15 wt. % Hf (55 at. % Ni—40 at. % Ti—5 at. % Hf). The signature of the crystal structure for each compound, represented by its diffraction pattern, is shown on the x-axis and the intensity of the signature, indicated by the number of x-ray counts, is shown on the y-axis. Tables 3A-C below list the crystalline phases that have been identified for 60-NITINOL, and two embodiments of modified NITINOL, 59 wt. % Ni—38 wt. % Ti—3 wt. % Hf (55 at. % Ni—44 at. % Ti—1 at. % Hf) and 53 wt. % Ni—32 wt. % Ti—15 wt. % Hf (55 at. % Ni—40 at. % Ti—5 at. % Hf): NiTi, $Ni_4Ti_3$, and $Ni_3Ti$.

TABLE 3A

| 60-NITINOL | | | |
|---|---|---|---|
| Chemical Formula | Compound Name | Crystal System | SemiQuant % |
| NiTi | Nickel Titanium | Cubic | 65 |
| $Ni_3Ti$ | Nickel Titanium | Hexagonal | 35 |

TABLE 3B

| 59 wt. % Ni - 38 wt. % Ti - 3 wt. % Hf (55 at. % Ni - 44 at. % Ti - 1 at. % Hf) | | | |
|---|---|---|---|
| Chemical Formula | Compound Name | Crystal System | SemiQuant % |
| NiTi | Nickel Titanium | Cubic | 24 |
| $Ni_3Ti$ | Nickel Titanium | Hexagonal | 13 |
| $Ni_4Ti_3$ | Nickel Titanium | Rhombohedral | 62 |

TABLE 3C

| 53 wt. % Ni - 32 wt. % Ti - 15 wt. % Hf (55 at. % Ni - 40 at. % Ti - 5 at. % Hf) | | | |
|---|---|---|---|
| Chemical Formula | Compound Name | Crystal System | SemiQuant % |
| NiTi | Nickel Titanium | Cubic | 19 |
| $Ni_4Ti_3$ | Nickel Titanium | Rhombohedral | 37 |

TABLE 3C-continued

| 53 wt. % Ni - 32 wt. % Ti - 15 wt. % Hf (55 at. % Ni - 40 at. % Ti - 5 at. % Hf) | | | |
|---|---|---|---|
| Chemical Formula | Compound Name | Crystal System | SemiQuant % |
| NiTi | Nickel Titanium | Hexagonal | 45 |

While 60-NITINOL is only composed of NiTi and incoherent $Ni_3Ti$, which does not harden the material, the modified versions 59 wt. % Ni—38 wt. % Ti—3 wt. % Hf (55 at. % Ni—44 at. % Ti—1 at. % Hf) and 53 wt. % Ni—32 wt. % Ti—15 wt. % Hf (55 at. % Ni—40 at. % Ti—5 at. % Hf) also include the beneficial $Ni_4Ti_3$ phase, which increases hardness. In fact, at 5 atomic percent Hf, none of the incoherent $Ni_3Ti$ is present in the microstructure. This means that modified NITINOL can be heat treated at a lower temperature to reduce or eliminate warping, dimensional distortion, and quench cracking. Also, the maximum hardening from heat treatment, obtained when the $Ni_3Ti$ phase is eliminated, can still be obtained.

When most materials experience a compressive force, they typically only deform elastically to less than 0.5% before they can no longer return to their original shape. This is sometimes referred to as recoverable strain because more deformation will cause the material to deform plastically, where it will not recover to its original shape. Highly elastic materials, however, can undergo much greater deformation and still return to their original length.

Figure 6:
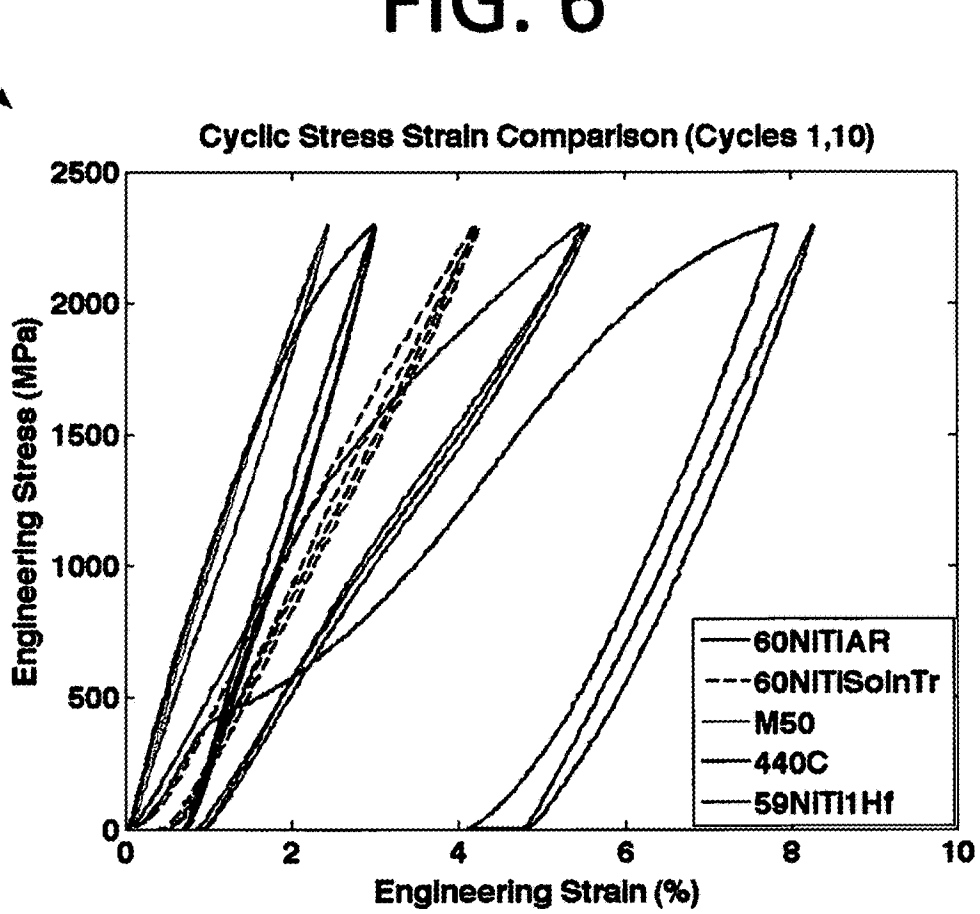
FIG. 6 is a graph illustrating the stress-strain behavior for 60-NITINOL, modified NITINOL, and 440C stainless steel (a typical bearing steel) in compression, according to an embodiment of the present invention.

FIG. 6 is a graph 600 illustrating the stress-strain behavior for 60-NITINOL, modified NITINOL, and 440C stainless steel (a typical bearing steel) in compression, according to an embodiment of the present invention. Each sample was loaded and unloaded incrementally with a compressive force (i.e., cycled) to 500 MPa, 1000 MPa, 1500 MPa, 2000 MPa, and 2500 MPa. Based on the span along the axis indicating percent engineering strain, the steel exhibited a recoverable strain of less than 0.3%, while the highly elastic materials had recoverable strains closer to 2-2.5%. These values can be increased further with cyclic training. Nonetheless, the NITINOL already has an order of magnitude greater recoverable strain than conventional bearing materials.

Figure 7:
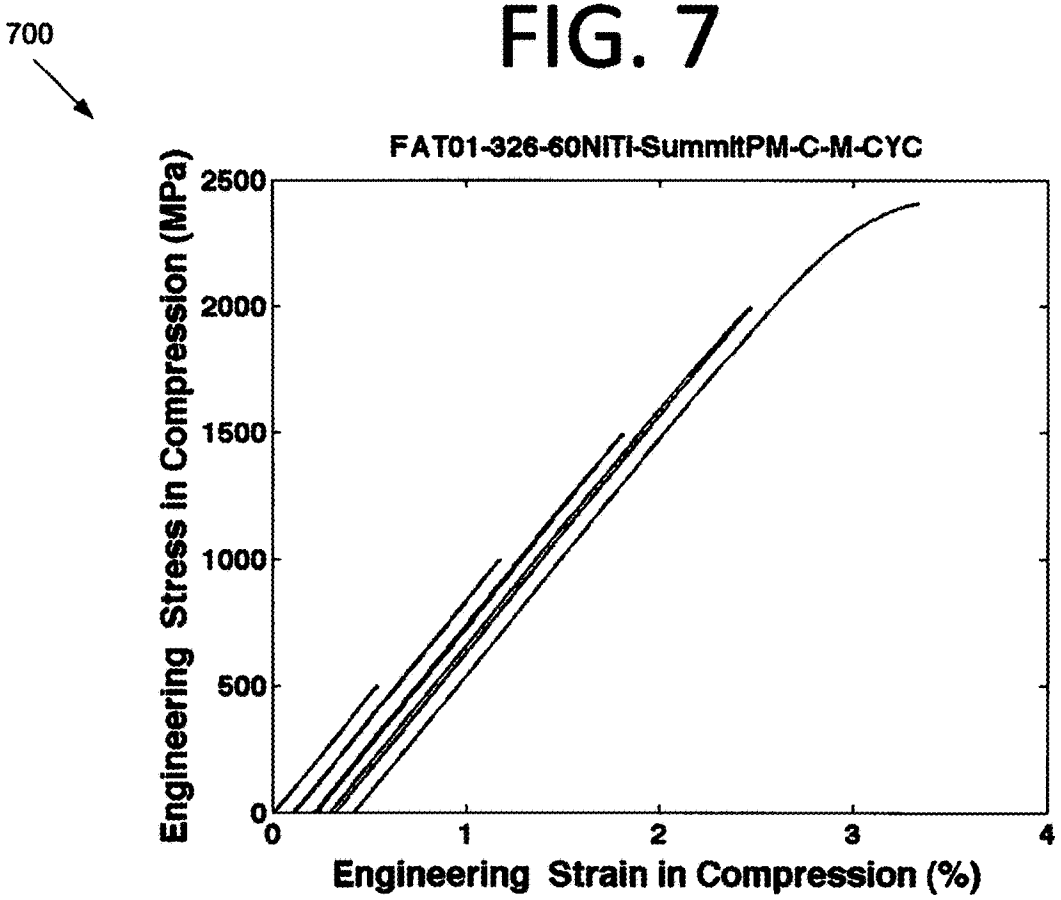
FIG. 7 is a graph illustrating compressive stress versus strain for cyclic compression of 60-NITINOL.

FIG. 7 is a graph 700 illustrating compressive stress versus strain for cyclic compression of 60-NITINOL. Each curve actually starts at 0% strain, though they are spaced along the strain axis for viewing purposes. As can be seen from the curves, the recoverable strain is greater than 2% even up to approximately 2,000 megapascals (MPa). Testing much beyond this load is not currently possible with conventional test equipment and techniques.

Figure 8A:
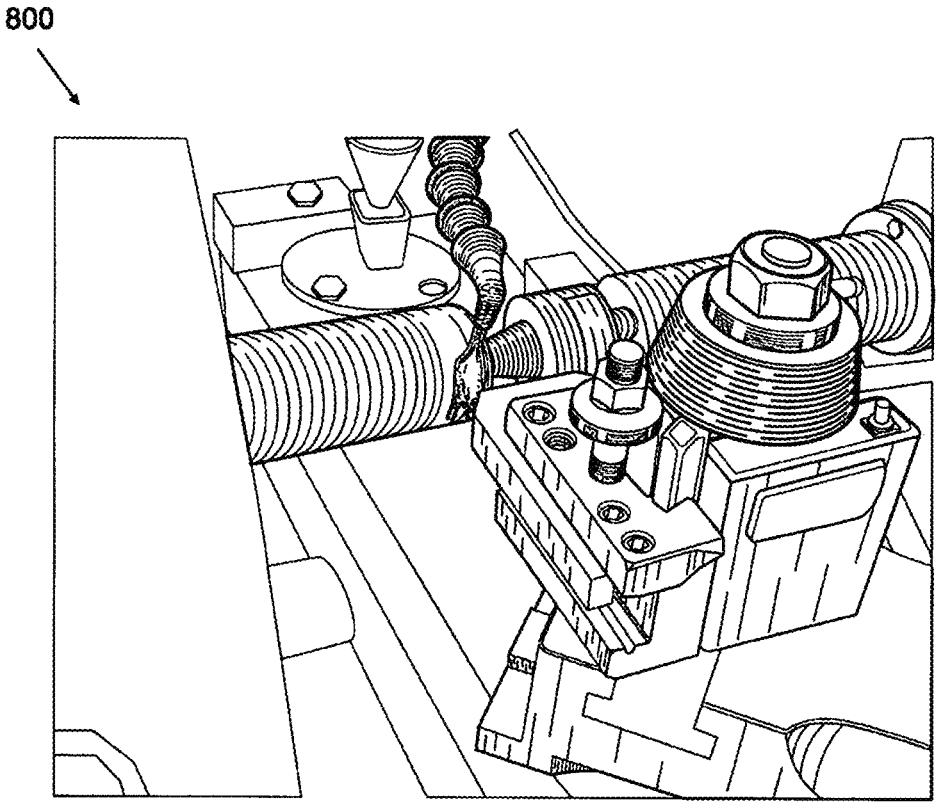
FIG. 8A is an image illustrating a bar of modified NITINOL being machined by a turning operation, according to an embodiment of the present invention.
Figure 8B:
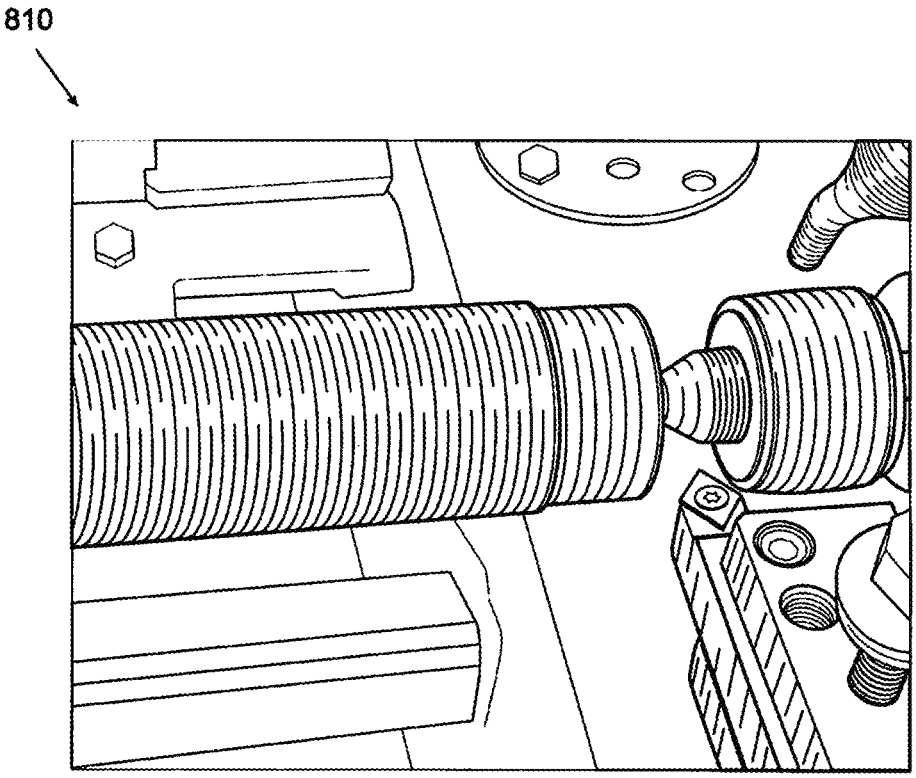
FIG. 8B is an image illustrating the part finish of machined modified NITINOL, according to an embodiment of the present invention.

In addition to being readily hardenable and highly elastic, modified NITINOL is also relatively easy to machine by electrical discharge machining or with orthogonal cutting processes such as milling and turning. FIG. 8A is an image 800 illustrating a bar of modified NITINOL that is approximately 1.125 inches in diameter being turned with conventional tooling used for aerospace grade Ni- and Ti-based alloys. The tool used for this operation was intentionally used without a chip breaker, which is why the photograph shows that the material forms a continuous chip. In this case, the continuous chip illustrates how freely modified NITINOL may be machined using a rotational speed and feed rate comparable to those used for typical Ni- or Ti-based alloys. The part finish shown in image 810 of FIG. 8B is excellent.

Figure 9:
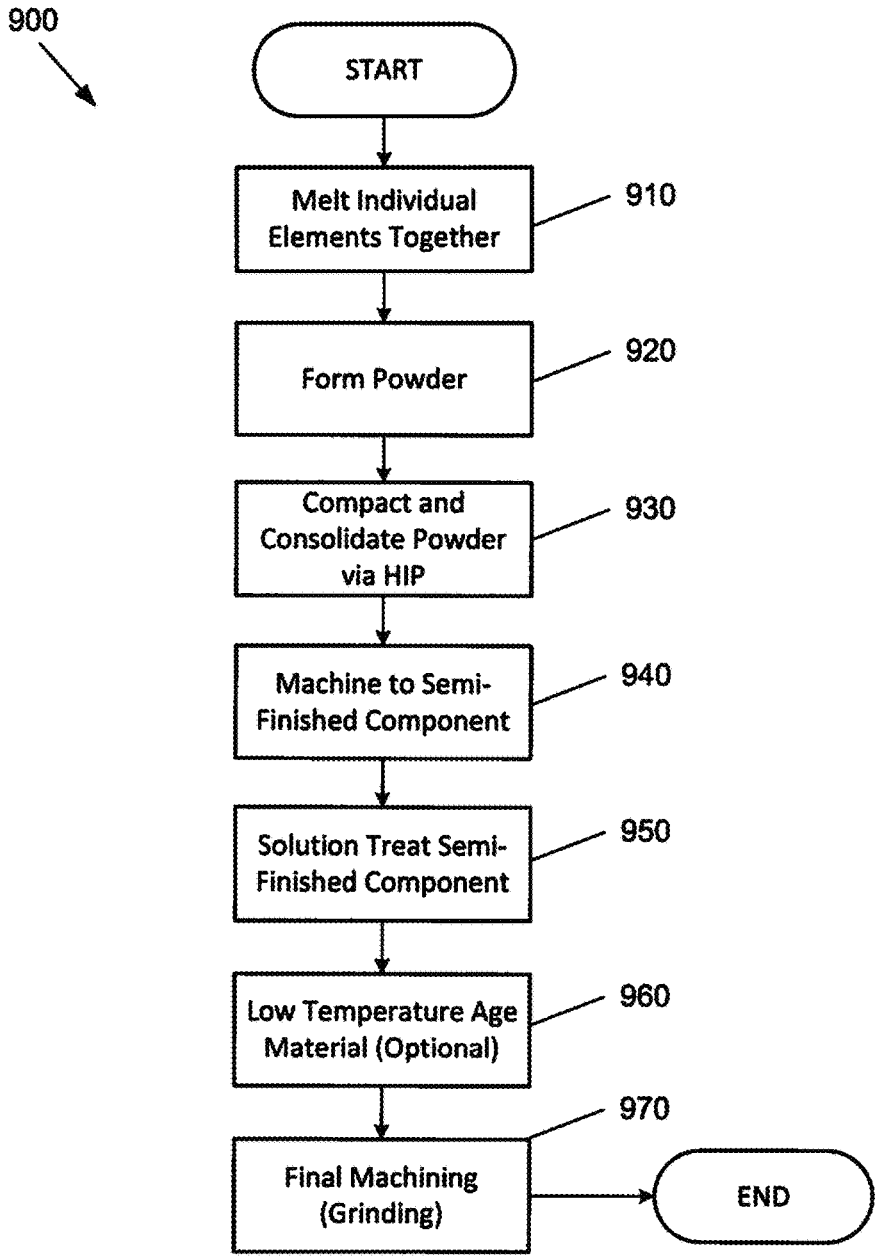
FIG. 9 is a flowchart illustrating a process for creating modified NITINOL bearings, according to an embodiment of the present invention.

FIG. 9 is a flowchart 900 illustrating a process for creating modified NITINOL bearings, according to an embodiment of the present invention. The process begins with melting individual elements together at 910. For instance, if modified NITINOL including Ni, Ti, Zr, and Hf is desired, these elements would be added in the correct proportions and melted together. Next, a powder is formed from the composition resulting from the melt process at 920. Powder may be preferable to a solid billet for creating bearings since it tends to be more uniform. However, in some embodiments, a solid billet is formed and step 930 is skipped.

The powder is pressed into a solid compact using hot isostatic pressing (HIP) at 930. In HIP, a hot gas pressurized container is heated and the powder is consolidated as a result. The consolidated powder compact is then machined into a semi-finished component (e.g., a bearing, a raceway, etc.) at 940. The semi-finished component is then solution treated at 950. In solution treatment, the material is heated above the solvus temperature for an appropriate time, and then immediately quenched, air cooled, or furnace cooled to room temperature. The precise temperature for the solution treatment depends on the composition of the material, but will typically be at least 900° C.

In some embodiments, the material may already be hard enough for the desired bearing application. However, if this is not the case, an optional low temperature age may be performed at 960. In some embodiments, the temperature may be 300-600° C., and the time of the age may be anywhere from 15 minutes to 100 hours. However, any suitable temperature and age time may be used, as would be understood by one of ordinary skill in the art. Final machining or grinding is then performed on the component at 970.

In some embodiments, a severe water quench is not necessary as air cooling, or even furnace cooling, at a lower cooling rate is sufficient to retain the desired microstructure. Air cooling implies that the sample is removed from the furnace and cooled in air. Furnace cooling is when the power is reduced or turned off and the sample is allowed to stay in the furnace during cooling. This eliminates quench cracking and reduces the risk of thermal distortion.

In summary, one or more substitutional elements can be used to reduce the solution treatment temperature and required cooling rates of 60-NITINOL. The advantages of modified NITINOL include that less energy is consumed during the heat treatment process, the material is subjected to less thermal distortion, and less machining is required. Modified NITINOL in some embodiments has adequate hardness for bearing applications and displays highly elastic behavior.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention as claimed, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that embodiments of the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. A material comprising:

54-57 atomic percent nickel (Ni);

0.1 up to and including 27 atomic percent of the sum of one or more elements from the group consisting of zirconium (Zr), hafnium (Hf), rutherfordium (Rf), lanthanum (La), and tantalum (Ta); and a balance of the material being titanium (Ti) by atomic percent, wherein the material has a lower solvus temperature than that of 60-NITINOL, wherein the material possesses a hardness between 56 and 62 on the Rockwell C (HRC) hardness scale.

2. The material of claim 1, wherein the material is formed without quench cracking.

3. The material of claim 1, wherein the material has a hardness between 58 and 62 HRC.

4. The material of claim 1, wherein the material exhibits highly elastic behavior with recoverable strains greater than 2%.

5. The material of claim 1, wherein the material has a Youngs modulus of less than 110 gigapascals (GPa).

6. The material of claim 1, wherein the material has a density of 6.5 g/cm$^3$.

7. The material of claim 1, wherein no water quenching is used to produce the material.

8. The material of claim 1, wherein the material comprises Hf from the one or more elements from the group consisting of Zr, Hf, Rf, La and Ta; and includes a Ni—Ti parent phase and a secondary $HfO_2$ phase.

9. The material of claim 8, wherein the material does not include a $Ni_3Ti$ phase.

* * * * *